US006527510B2

(12) United States Patent
Olhofer et al.

(10) Patent No.: US 6,527,510 B2
(45) Date of Patent: Mar. 4, 2003

(54) STATOR BLADE AND STATOR BLADE CASCADE FOR AXIAL-FLOW COMPRESSOR

(75) Inventors: Markus Olhofer, Seligenstadt (DE); Bernhard Sendhoff, Seligenstadt (DE); Edgar Körner, Seligenstadt (DE); Yoshihiro Yamaguchi, Wako (JP); Toyotaka Sonoda, Wako (JP); Toshiyuki Arima, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/866,924

(22) Filed: May 30, 2001

(65) Prior Publication Data

US 2002/0021968 A1 Feb. 21, 2002

(30) Foreign Application Priority Data

May 31, 2000 (DE) ..... 100 27 084

(51) Int. Cl.[7] ..... F04D 29/44
(52) U.S. Cl. ..... 415/191; 415/181
(58) Field of Search ..... 415/191, 181, 415/208.2, 211.2

(56) References Cited

U.S. PATENT DOCUMENTS 2,935,246 A * 5/1960 Roy
3,333,817 A * 8/1967 Rhomberg
4,968,216 A * 11/1990 Anderson et al. ..... 415/199.5
6,354,798 B1 * 3/2002 Deckers ..... 415/192
6,358,012 B1 * 3/2002 Staubach ..... 416/228
6,375,419 B1 * 4/2002 LeJambre et al. ..... 415/191

* cited by examiner

*Primary Examiner*—Edward K. Look
*Assistant Examiner*—James M McAleenan
(74) *Attorney, Agent, or Firm*—Arent Fox Kintner Plotkin & Kahn, PLLC

(57) ABSTRACT

It is an object of the present invention to provide a stator blade for an axial-flow compressor, in which the wave drag due to the generation of a shock wave in a transonic speed range can be suppressed to the minimum. For this purpose, the stator blade in the axial-flow compressor has an intrados producing a positive pressure, and an extrados producing a negative pressure. Both of the intrados and the extrados are located on one side of a chord line. A first bulge and a second bulge are formed on the intrados of the stator blade at a location on the side of a leading edge and on the side of a trailing edge, respectively. Thus, the generation of a shock wave on the extrados can be moderated to reduce the wave drag by positively producing the separation of a boundary layer on the intrados by the first bulge. In addition, the boundary layer rendered unstable by the first bulge on the intrados can be stabilized again by the second bulge on the intrados and hence, the increase in frictional drag due to the separation of the boundary layer on the intrados can be suppressed to the minimum.

8 Claims, 12 Drawing Sheets

STATOR BLADE AND STATOR BLADE CASCADE FOR AXIAL-FLOW COMPRESSOR

BACKGROUND OF THE INVENTION

1. Field of the Invention

The present invention relates to a stator blade and a stator blade cascade for an axial-flow compressor such as a gas turbine, and particularly, to a stator blade and a stator blade cascade in an axial-flow compressor, in which the pressure loss in a transonic range can be reduced.

2. Description of the Related Art

There are rotor blades for an axial-flow compressor known from Japanese Patent Application Laid-open Nos. 9-256997 and 8-254156, in which a recess is formed at a substantially central location or at a location near a leading edge on the extrados (a negative pressure surface) of a blade profile, so that two shock waves are generated in a transonic range to inhibit the separation of a boundary layer, thereby providing a reduction in pressure loss. There is a blade profile applicable to both of a compressible fluid and an incompressible fluid, which is known from U.S. Pat. No. 5,395,971, in which a recess is formed at a substantially central location on each of the intrados (a positive pressure surface) and an extrados (a negative pressure surface), so that a laminar flow boundary layer region is kept long and inhibited from being separated, thereby providing an enhancement in performance at a high attack angle.

In addition, there is a rotor blade cascade for an axial-flow compressor known from Japanese Patent Application Laid-open No. 11-13692, which is designed so that the generation of a shock wave between blades is moderated by defining the distance between the intrados and extrados of adjacent rotor blades in a range of 5% from the hub of the rotor blade. Further, there is a blade profile applicable to both of a compressible fluid and an incompressible fluid, which is known from U.S. Pat. No. 5,395,071, in which a recess is formed at a substantially central location on each of intrados (a positive pressure surface) and an extrados (a negative pressure surface), so that a laminar flow boundary layer region is kept long and inhibited from being separated, thereby providing an enhancement in performance at a high attack angle.

If the flow entering the stator blade of the axial-flow compressor reaches a critical mach number, the flow speed reaches a sonic speed on the extrados of the stator blade to generate a shock wave. For this reason, a large wave drag or compressibility drag is produced to cause a reduction in performance. Therefore, to provide an enhancement in performance of the axial-flow compressor, it is necessary to moderate the shock wave generated on the extrados of the stator blade to reduce the wave drag.

SUMMARY OF THE INVENTION

Accordingly, it is an object of the present invention to provide a stator blade and a stator blade cascade for an axial-flow compressor, wherein the wave drag due to the generation of a shock wave in the transonic speed range can be suppressed to the minimum.

To achieve the above object, according to a first aspect and feature of the present invention, there is provided a stator blade for an axial-flow compressor, having an intrados producing a positive pressure and an extrados producing a negative pressure, the stator blade being disposed in an annular fluid passage, both of the intrados and extrados being on one side of a chord line, characterized in that the stator blade includes a first bulge and a second bulge on the intrados at locations on the side of a leading edge and on the side of a trailing edge, respectively.

According to a second aspect and feature of the present invention, in addition to the first feature, there is provided a stator blade for an axial-flow compressor, characterized in that the distance Xa from the leading edge to a front end of the second bulge is in a range of $0.60<Xa/C<0.90$ with respect to a chord length C.

According to a third aspect and feature of the present invention, in addition to the second feature, there is provided a stator blade for an axial-flow compressor, characterized in that the distance Xb from the leading edge to a rear end of the first bulge is in a range of $0.05<Xb/C<0.40$ with respect to a chord length C.

With the first to third features, when the fluid flows to the stator blade disposed in the annular fluid passage, the separation of a boundary layer is produced positively by the first bulge provided on the intrados on the side of the leading edge, whereby the generation of a shock wave on the extrados of the stator blade adjacent the intrados can be moderated to reduce the wave drag. A small increase in frictional drag is produced due to the separation of the boundary layer at the first bulge, but this increase is by far smaller, as compared with a decrease in the wave drag produced by the moderation of the generation of the shock wave and hence, the drag on the entire stator blade can be reduced substantially. The boundary layer rendered unstable by the first bulge at the leading edge of the intrados can be stabilized again by the second bulge at the trailing edge of the intrados and hence, the increase in frictional drag due to the separation of the boundary layer on the intrados can be suppressed to the minimum.

In addition, the above-described effect can be exhibited particularly satisfactorily by setting the distance Xa from the leading edge to the front end of the second bulge in the range of $0.60<Xa/C<0.90$ with respect to the chord length C and by setting the distance Xb from the leading edge to a rear end of the first bulge in the range of $0.05<Xb/C<0.40$ with respect to the chord length C.

To achieve the above object, according to a fourth aspect and feature of the present invention, there is provided a stator blade cascade for an axial-flow compressor, comprising a large number of stator blades disposed in an annular fluid passage, each the stator blade having an intrados producing a positive pressure and an extrados producing a negative pressure, characterized in that a distribution of distances in a chord-wise direction between the intrados of one of two adjacent stator blades and the extrados of the other of the adjacent stator blades increases from a leading edge toward a trailing edge and reaches a maximum value; then decreases and reaches a minimum value; and then increases again.

According to a fifth aspect and feature of the present invention, in addition to the fourth feature, there is provided a stator blade for an axial-flow compressor, characterized in that the distance is a length of a perpendicular line drawn from the intrados of the one stator blade to the extrados of the other stator blade.

According to a sixth aspect and feature of the present invention, in addition to the fourth feature, there is provided a stator blade for an axial-flow compressor, characterized in that the flow on the extrados of the stator blade is stabilized in a region where the distance assumes the maximum value.

According to a seventh aspect and feature of the present invention, in addition to the fourth feature, there is provided a stator blade for an axial-flow compressor, characterized in that the flow on the intrados of the stator blade is stabilized in a region where the distance assumes the minimum value.

According to an eighth aspect and feature of the present invention, in addition to the fourth feature, there is provided a stator blade for an axial-flow compressor, characterized in that the ratio of the chord length of the stator blade to the distance between adjacent stator blades is in a range of 1.5 to 3.0.

With the fourth to eighth features, by rendering unstable a boundary layer on the intrados in the region where the distance between the intrados and extrados of the stator blade cascade assumes the maximum value to positively separate the boundary layer, the generation of a shock wave on the extrados opposed to the boundary layer rendered unstable can be inhibited to reduce the wave drag. A small increase in frictional drag is produced due to the separation of the boundary layer on the intrados. However, such increase is by far smaller, as compared with a reduction in the wave drag caused by the moderation of the generation of the shock wave, and hence, the overall drag can be reduced substantially. In addition, the distance between the intrados and the extrados in the stator blade cascade reaches the maximum value and then decreases down to the minimum value and hence, by throttling the flow to accelerate it again in the region where the distance assumes the minimum value, the boundary layer can be stabilized to inhibit the promotion of the separation, thereby inhibiting an increase in frictional drag due to the separation of the boundary layer on the intrados.

The distance between the intrados and the extrados in the stator blade cascade can be defined appropriately as a length of a perpendicular line drawn from the intrados of one stator blade to the extrados of the other stator blade. Further, the above-described effect can be exhibited particularly satisfactorily by setting the ratio of the chord length of the stator blade to the distance between adjacent stator blades in a range of 1.5 to 3.0.

The above and other objects, features and advantages of the invention will become apparent from the following description of the preferred embodiments taken in conjunction with the accompanying drawings.

BRIEF DESCRIPTION OF THE DRAWINGS

FIGS. 1 to 12B show embodiments of the present invention, wherein

FIG. 1 is a diagram showing a profile of a blade according to a first embodiment and variations in curvatures of an intrados and an extrados of the blade;

FIG. 3 is a diagram showing a profile of a blade according to a second embodiment and variations in curvatures of an intrados and an extrados of the blade;

FIG. 5 is a diagram showing a profile of a blade according to a third embodiment and variations in curvatures of an intrados and an extrados of the blade;

FIG. 7 is a diagram showing the distribution of chordwise distance between the intrados and extrados of adjacent stator blades;

FIG. 8 is a diagram showing the relationship between the mach number and the pressure loss coefficient;

FIG. 9 is a diagram showing the behavior of a flow about the stator blade according to the first embodiment in a visualized manner;

FIG. 10 is a diagram showing the behavior of a flow about a stator blade of a comparative example in a visualized manner;

FIG. 11 is a diagram showing a profile of the blade of the comparative example and variations in curvatures of an intrados and an extrados of the blade; and FIGS. 12A and 12B are diagrams showing a stator blade cascade of the blades of the comparative example and a variation in distance between the intrados and extrados in the stator blade cascade.

DESCRIPTION OF THE PREFERRED EMBODIMENTS

The present invention will now be described by way of embodiments with reference to the accompanying drawings.

Figure 1:
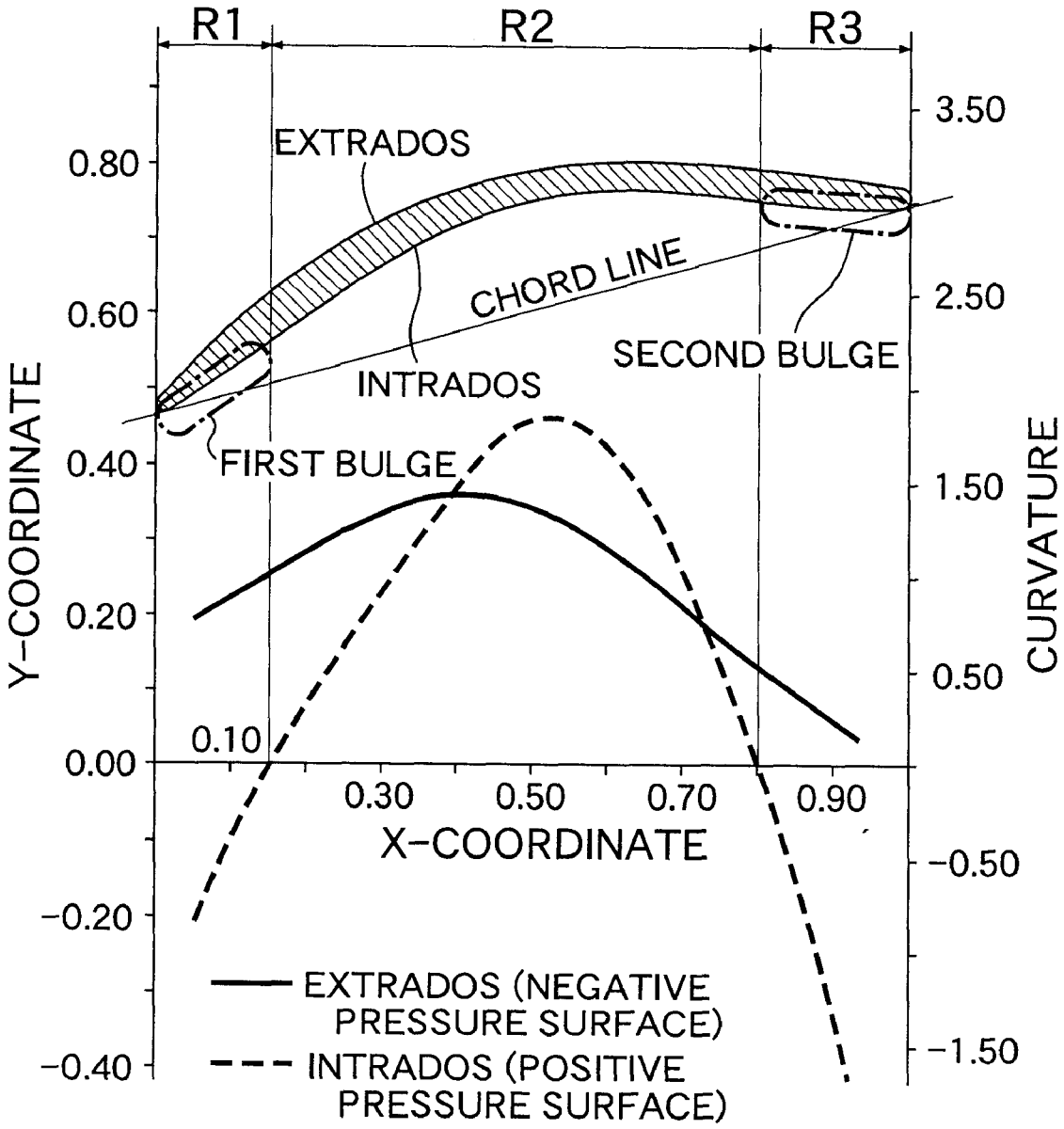

A stator blade according to a first embodiment shown in FIG. 1 is provided in an annular fluid passage in an axial-flow compressor. In the stator blade, a left end is a leading edge, and a right end is a trailing edge. An intrados (a positive pressure surface) producing a positive pressure with flowing of a fluid and an extrados (a negative pressure surface) producing a negative pressure with flowing the fluid, exist above a chord line tangent to the intrados at two points in the vicinity of the leading and trailing edges. There are various definitions for the chord line depending on the shape of the blade profile, but in the present invention, the chord line in the definition generally applied to a blade profile having an intrados and an extrados both curved toward the extrados, is employed. The axis of abscissas and the axis of ordinates in coordinates showing the blade profile are represented by percentage with the chord length C defined as 100%.

The curvature of the extrados shown by a solid line assumes a positive value over the entire chord length C and hence, the shape of the extrados is curved convexly upwards over the entire chord length C. On the other hand, the curvature of the intrados shown by a broken line assumes a positive value in a region R2 of 15% to 80% of the chord length C, but assumes a negative value in a region R1 of 0% to 15% of the chord length C and in a region R3 of 80% to 100% of the chord length C. Therefore, the shape of the intrados is curved convexly upwards in the central region R2, but curved convexly downwards in the region R1 on the side of the leading edge and in the region R3 on the side of the trailing edge.

The curvature of the extrados increases monotonously from the leading edge toward the trailing edge and reaches a maximum value at near 40% of the chord length C, and then decreases monotonously. The curvature of the intrados increases monotonously from the leading edge toward the trailing edge and reaches a maximum value at near 54% of the chord length C, and then decreases monotonously.

In the intrados of the stator blade, a portion curved convexly downwards in the region R1 on the side of the leading edge constitutes a first bulge of the present invention, and a portion curved convexly downwards in the region R3 on the side of the trailing edge constitutes a second bulge of the present invention.

Figure 2A:
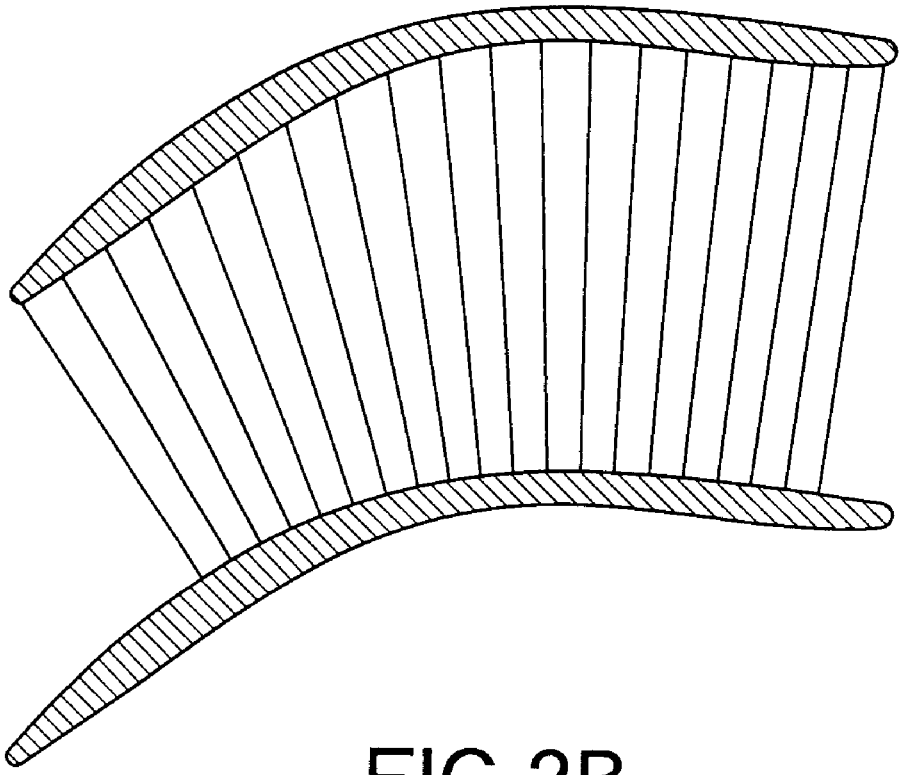
FIGS. 2A and 2B are diagrams showing a stator blade cascade of the blades according to the first embodiment and a variation in distance between the intrados and extrados in the stator blade cascade.
Figure 2B:
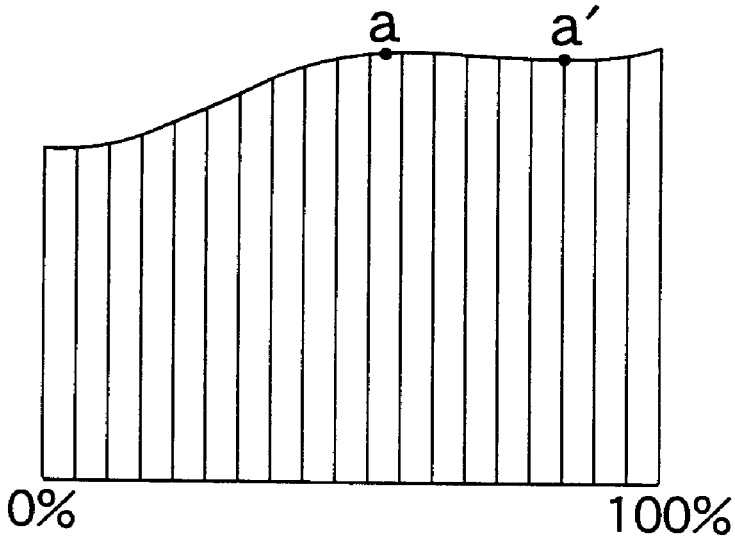

FIGS. 2A and 2B show a variation in distance between an intrados and an extrados of two adjacent stator blades in a stator blade cascade from a leading edge portion (a throat portion) to a trailing edge portion. As shown in FIG. 2A, a perpendicular line is drawn downwards from the intrados of the upper stator blade to the extrados of the lower stator blade, and a variation in the length of the perpendicular line in a direction of the chord is shown in FIG. 2B with the extrados of the lower stator blade being developed in a straight line. The variation in FIG. 2 enlarged in a direction of the axis of ordinates is shown by a solid line in FIG. 7. The distance between the intrados and the extrados increases from the leading edge portion toward the trailing edge portion and reaches a maximum value at a point a near 55% of the chord length C; then decreases and reaches a minimum value at a point a' near 82% of the chord length C, and then increases again.

Figure 3:
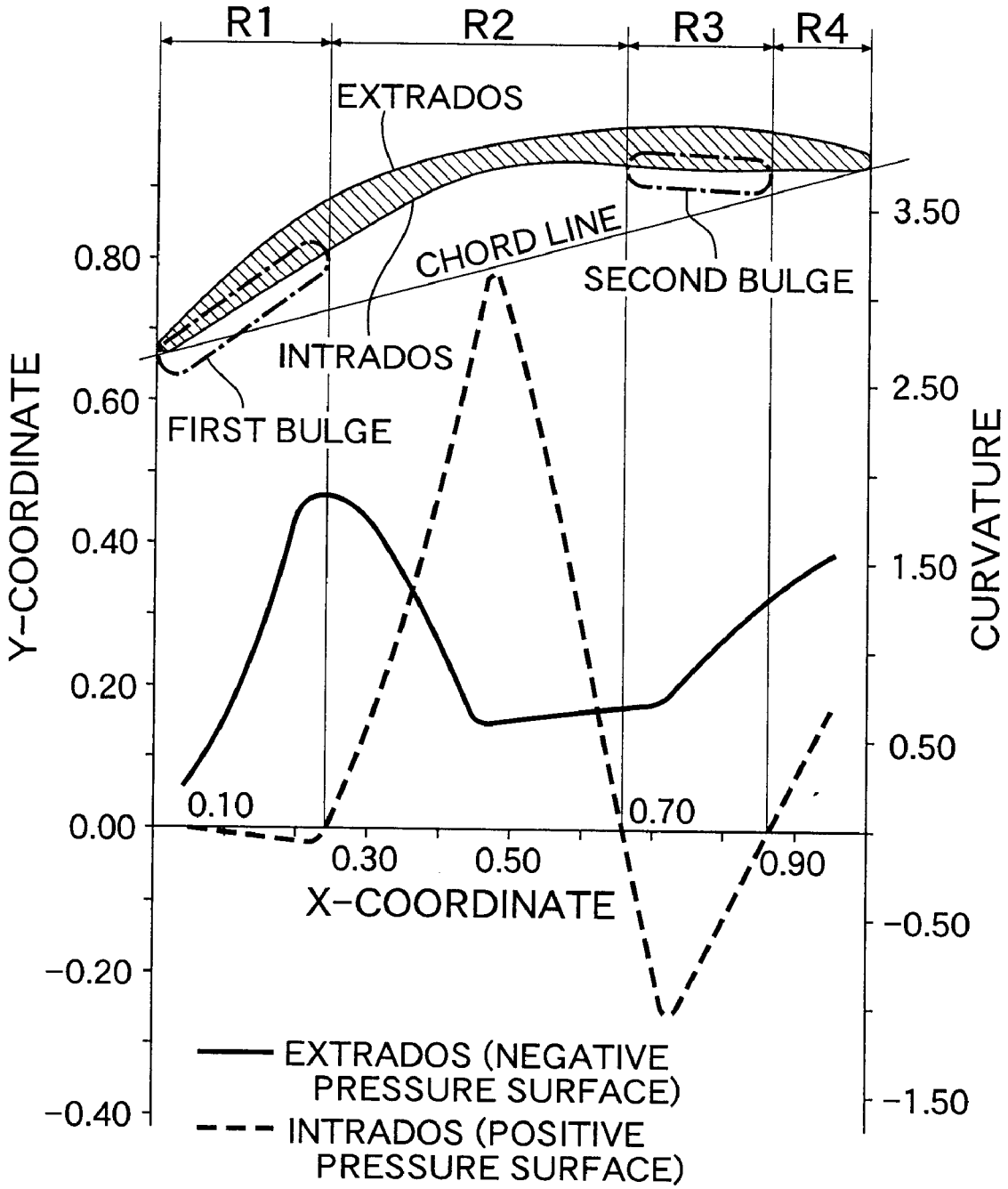

In a stator blade according to a second embodiment shown in FIG. 3, the curvature of an extrados shown by a solid line assumes a positive value over the entire chord length C. Therefore, the shape of the extrados is curved convexly upwards over the entire chord length C. On the other hand, the curvature of an intrados shown by a broken line assumes positive value in a region R2 of 24% to 66% of the chord length C and in a region R4 of 86% to 100% of the chord length C, but assumes a negative value in a region R1 of 0% to 24% of the chord length C and a region R3 of 66% to 86% of the chord length C. Therefore, the shape of intrados is curved convexly upwards in the two regions R2 and R4, but curved convexly downwards in the two other regions R1 and R3.

The curvature of the extrados increases from the leading edge toward the trailing edge and reaches a maximum value at near 22% of the chord length C; then decreases and reaches a minimum value at near 45% of the chord length C; and then increases. The curvature of the intrados decreases from the leading edge toward the trailing edge and reaches a minimum value at near 22% of the chord length C; then increases and reaches a maximum value at near 45% of the chord length C; then decreases and reaches a minimum value at near 73% of the chord length C; and then increases.

In the intrados of the stator blade, a portion curved convexly downwards in the region R1 on the side of the leading edge constitutes a first bulge of the present invention, a portion curved convexly downwards in the region R3 on the side of the trailing edge constitutes a second bulge of the present invention.

Figure 4A:
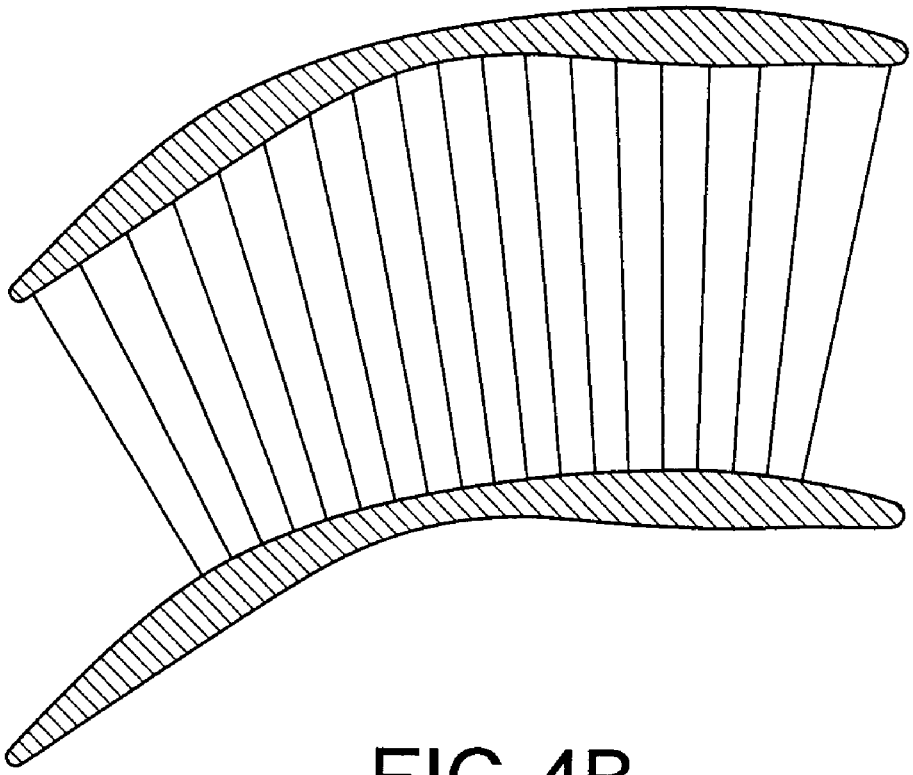
FIGS. 4A and 4B are diagrams showing a stator blade cascade of the blades according to the second embodiment and a variation in distance between the intrados and extrados in the stator blade cascade.
Figure 4B:
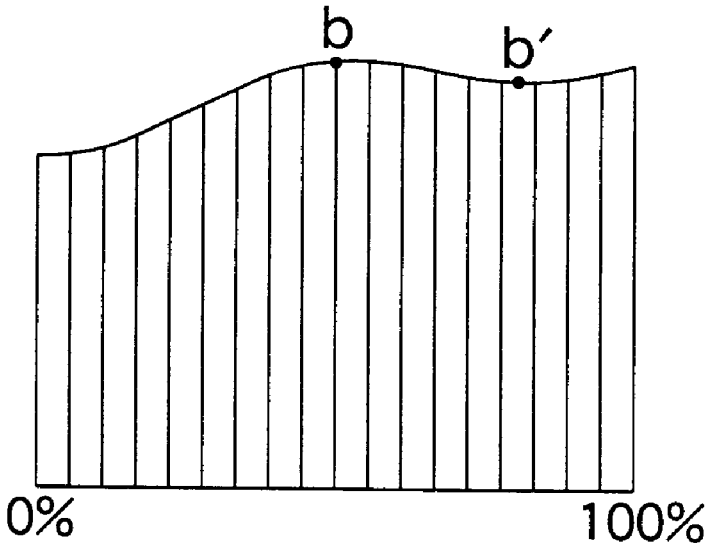
Figure 7:
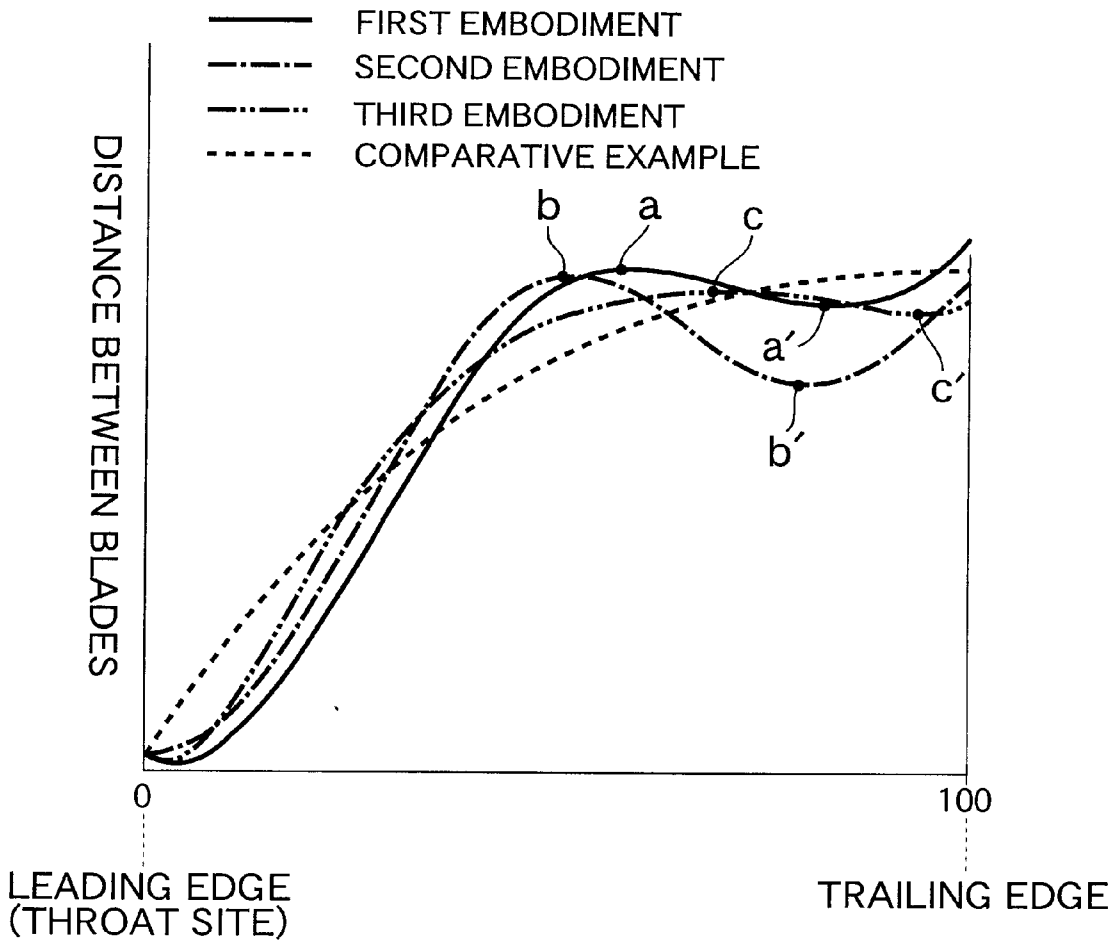

As shown in FIGS. 4B and 7 (see a one-dot dashed line), the distance between the intrados and the extrados in the stator blade according to the second embodiment increases from the leading edge toward the trailing edge and reaches a maximum value at a point b near 50% of the chord length C; then decreases and reaches a minimum value at a point b' near 80% of the chord length C, and then increases again.

Figure 5:
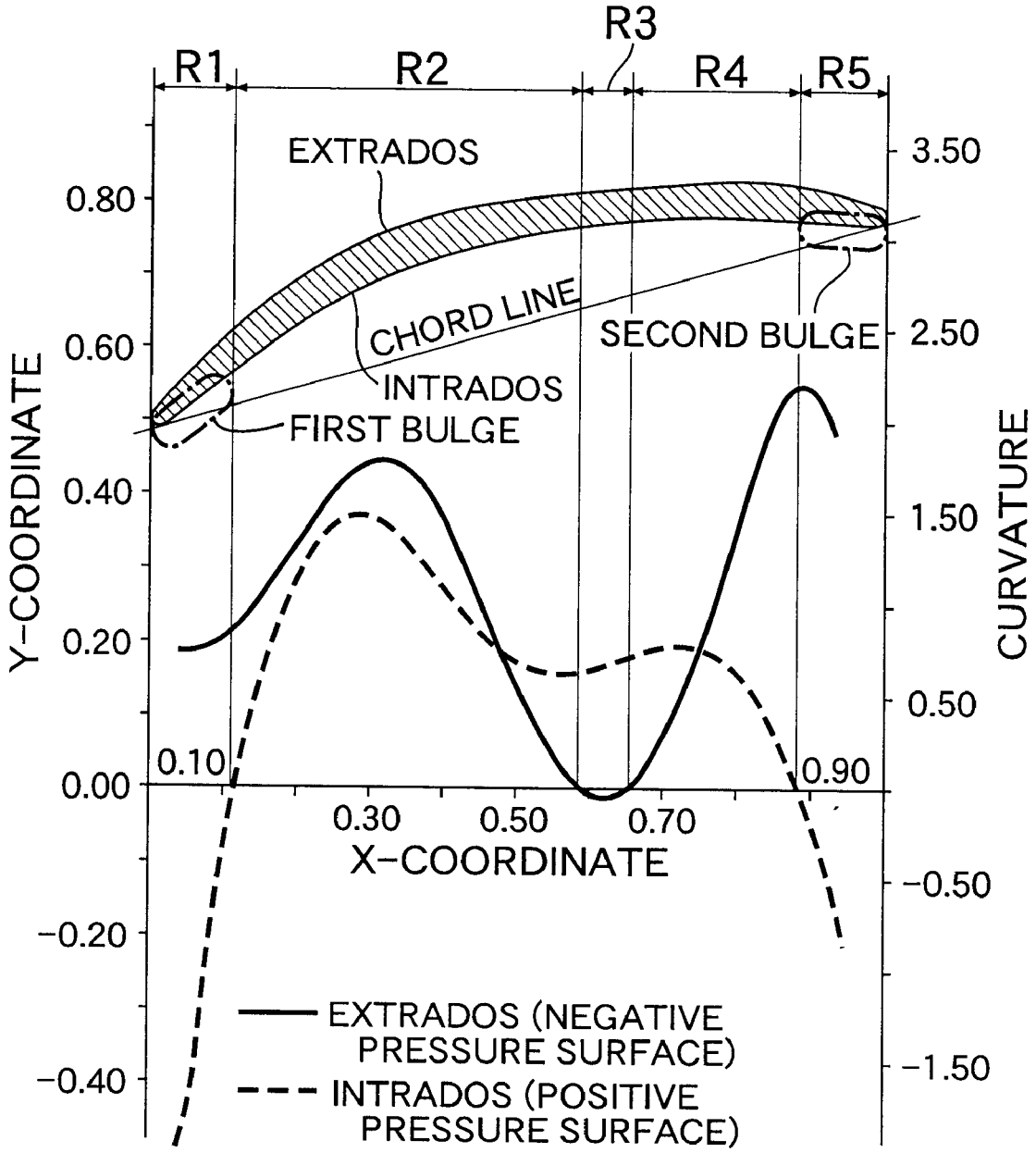

In a stator blade according to a third embodiment shown in FIG. 5, the curvature of an extrados shown by a solid line assumes a positive value in most of the entire region, but assumes a negative value only in a region R3 of 58% to 65% of the chord length C. Therefore, the shape of the extrados is curved convexly downwards in the region R3. On the other hand, the curvature of an intrados shown by a broken line assumes a positive value in regions R2, R3 and R4 of 11% to 88% of the chord length C, but assumes a negative value in a region R1 of 0% to 11% of the chord length C and in a region R5 of 88% to 100% of the chord length C. Therefore, the shape of the intrados is curved convexly upwards in the central regions R2 to R4, but curved convexly downwards in the region R1 on the side of the leading edge and in the region R5 on the side of the trailing edge.

The curvature of the extrados increases from the leading edge toward the trailing edge and reaches a maximum value at near 32% of the chord length C; then decreases and reaches a minimum value at near 62% of the chord length C; then increases and reaches a maximum value at near 90% of the chord length, and then decreases. The curvature of the intrados increases from the leading edge toward the trailing edge and reaches a maximum value at near 28% of the chord length C; then decreases and reaches a minimum value at near 56% of the chord length C; then increases and reaches a maximum value at near 75% of the chord length C, and then decreases.

In the intrados of the stator blade, a portion curved convexly downwards in the region R1 on the side of the leading edge constitutes a first bulge of the present invention, and a portion curved convexly downwards in the region R5 on the side of the trailing edge constitutes a second bulge of the present invention.

Figure 6A:
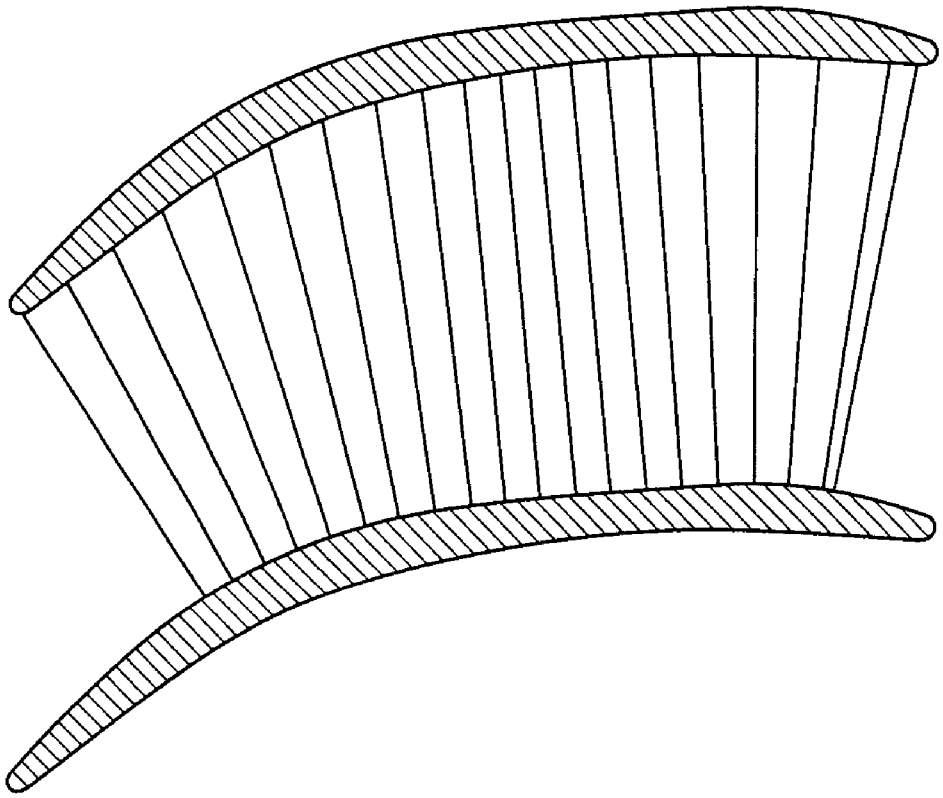
FIGS. 6A and 6B are diagrams showing a stator blade cascade of the blades according to the third embodiment and a variation in distance between the intrados and extrados in the stator blade cascade.
Figure 6B:
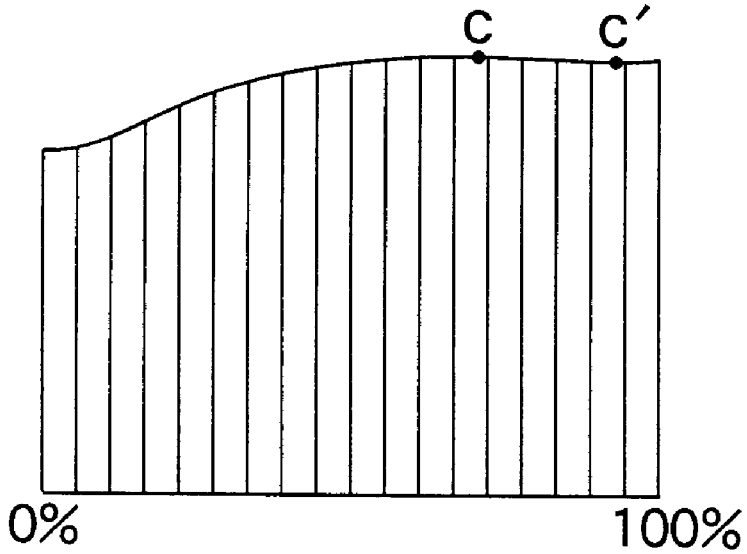

As shown in FIGS. 6B and 7 (see a two-dot dashed line), the distance between the intrados and extrados in the stator blade increases from the leading edge toward the trailing edge and reaches a maximum value at a point c near 70% of the chord length C; then decreases and reaches a minimum value at a point c' near 93% of the chord length C, and then increases again.

Figure 11:
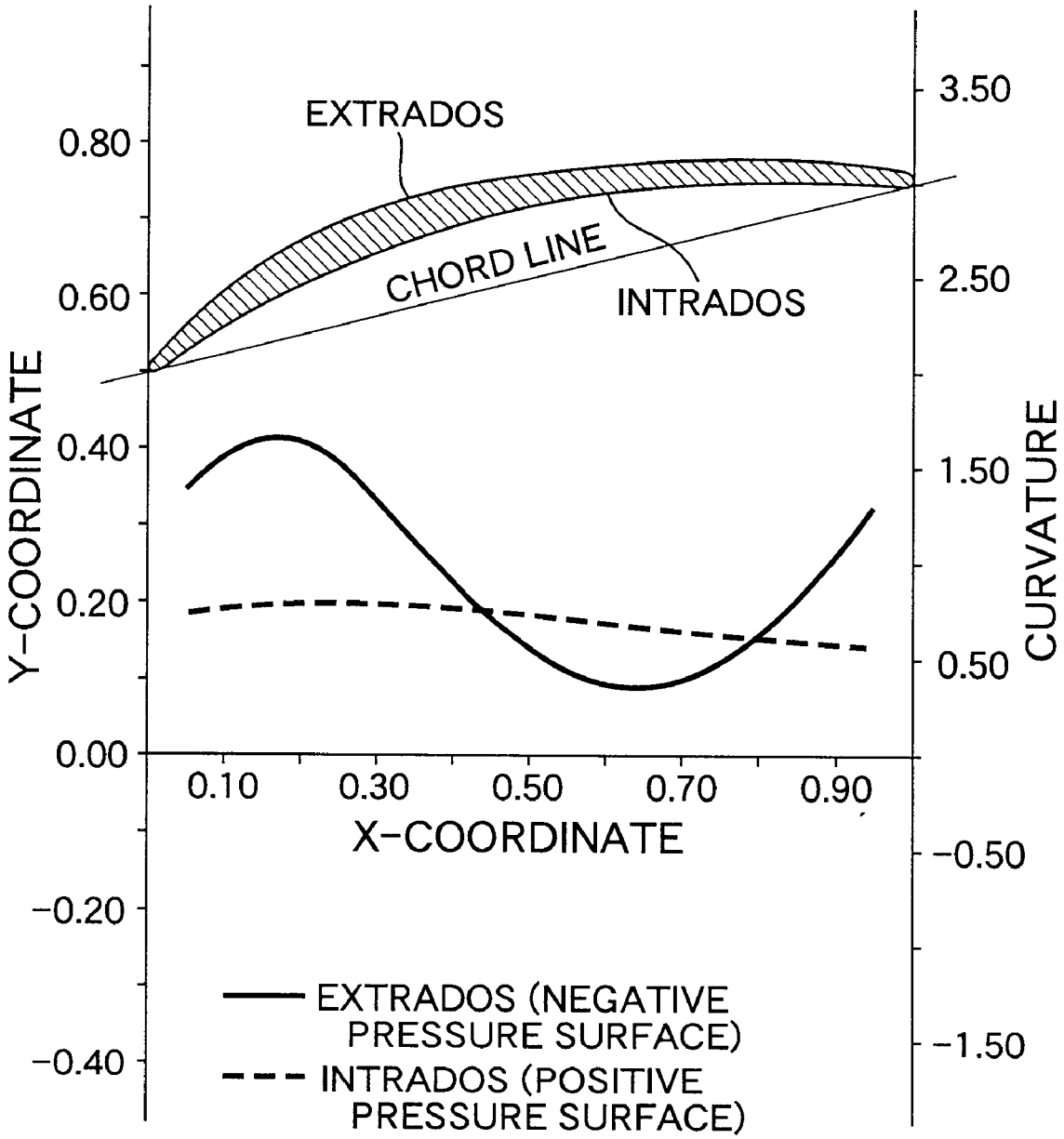
Figure 12A:
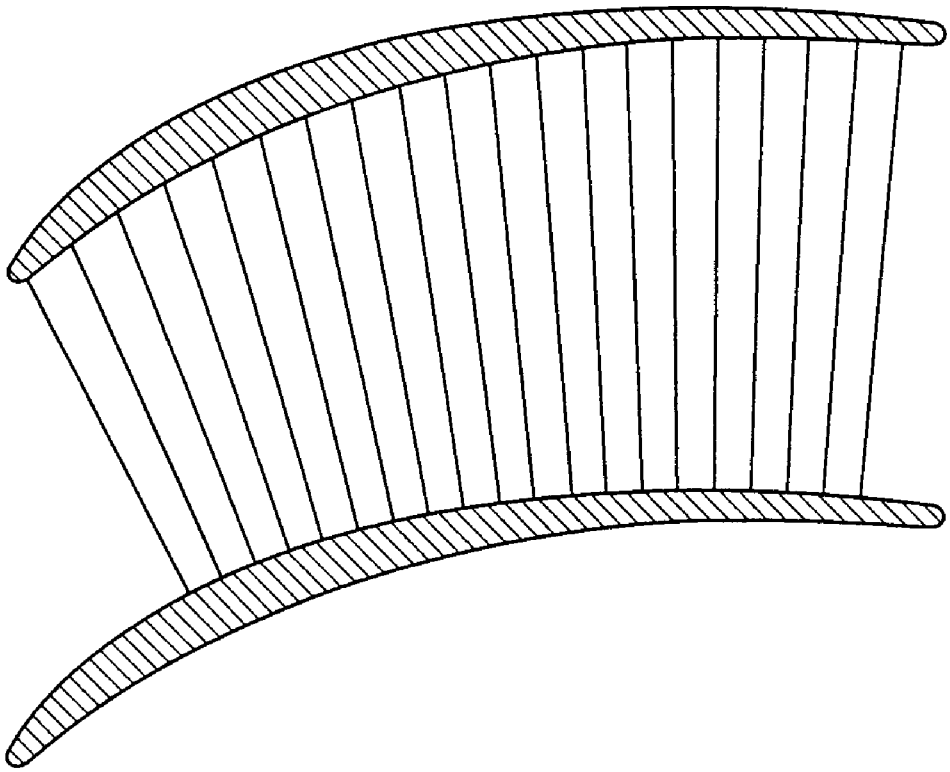
Figure 12B:
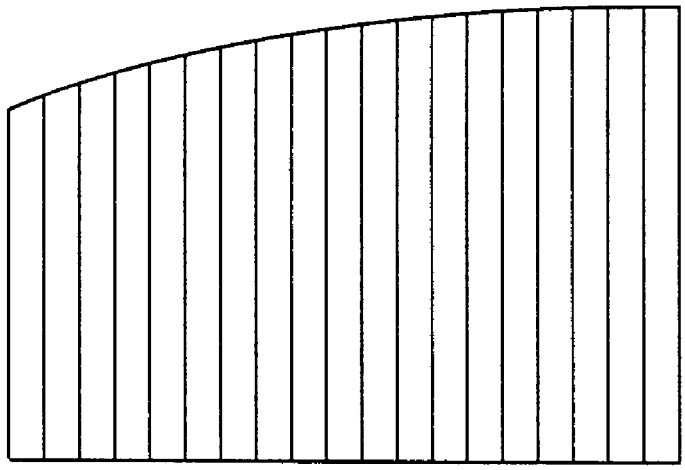

FIG. 11 shows a comparative example of a stator blade. The curvature of an intrados of the blade profile assumes a positive value in substantially the entire chord length C excluding extreme portions of the leading and trailing edges, and the curvature of an extrados assumes a positive value in the entire chord length C. Therefore, the intrados is not provided with first and second bulges similar to those in each of the first to third embodiments. As shown in FIGS. 12B and 7 (see a broken line), the distance between the intrados and extrados in a stator blade cascade in the comparative example increases monotonously from the leading edge toward the trailing edge while reducing the increase rate, with no maximum and minimum values.

Figure 8:
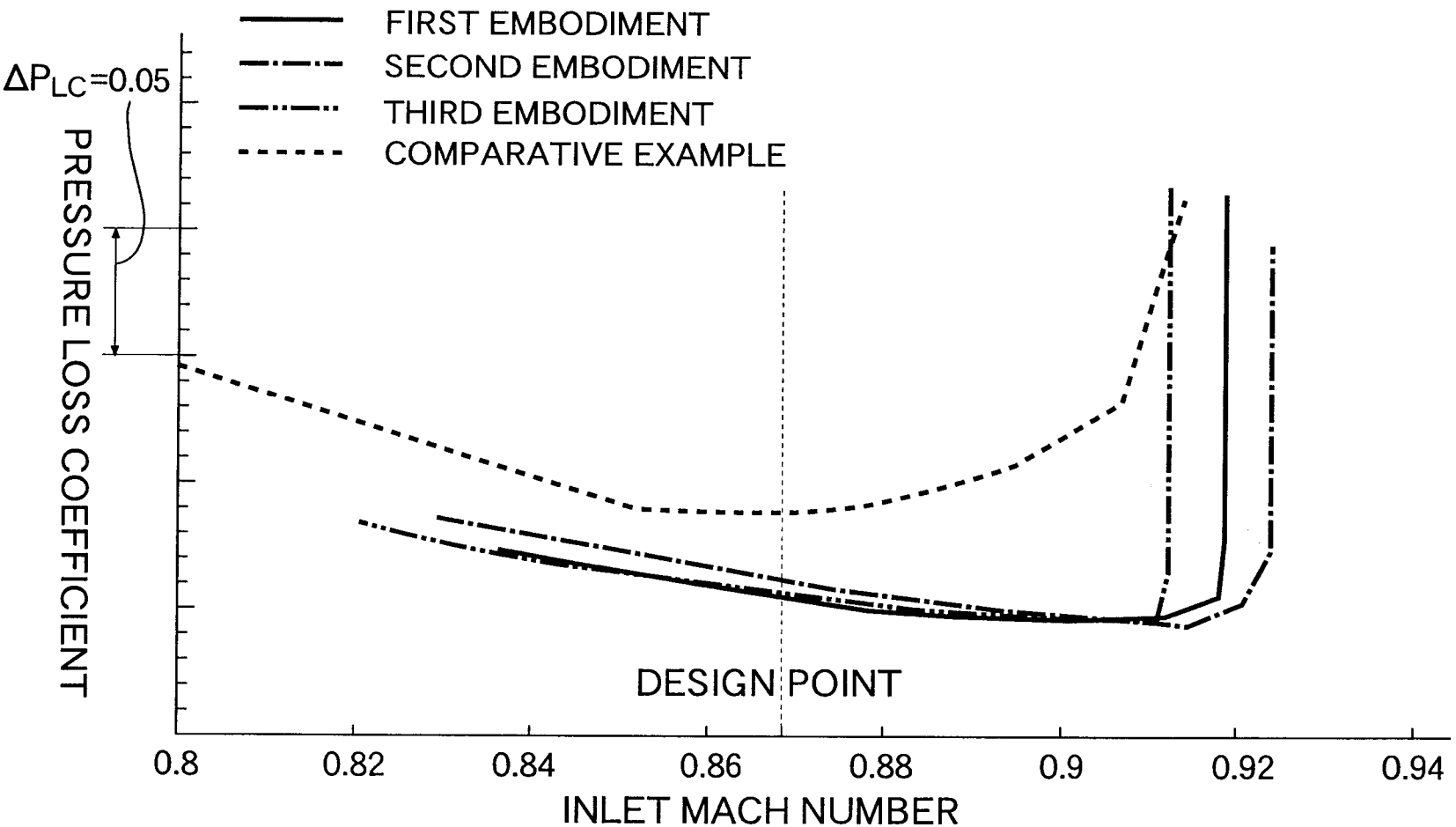

FIG. 8 shows the relationship between the mach number and the pressure loss coefficient at an inlet of the stator blade cascade in the first to third embodiments and the comparative example. As apparent from FIG. 8, in a mach number equal to 0.87 at the inlet of the stator blade cascade which is a design point, the pressure loss coefficient in each of the first to third embodiments is about 0.05 smaller than that in the comparative example.

The above-described effect in each of the first to third embodiments is provided mainly by the first bulge provided on the intrados of the stator blade at the location on the side of the leading edge and the second bulge provided on the intrados at the location on the side of the trailing edge. Thus, it is possible to inhibit the generation of a shock wave on the extrados of the stator blade to reduce the wave drag by rendering unstable a boundary layer in the rear of the first bulge provided on the intrados of the stator blade at the location on the side of the leading edge by the first bulge to positively separate the boundary layer. If the boundary layer is separated by the first bulge on the intrados, the frictional drag is increased, but the increment in frictional drag is by far smaller, as compared with the decrement in wave drag. This can contribute largely to a reduction in the overall drag.

Moreover, the boundary layer rendered unstable by the first bulge provided at the leading edge of the intrados is accelerated again and rendered stable by the second bulge provided at the trailing edge of the intrados, whereby the promotion of separation of the boundary layer is inhibited. Thus, the increase in frictional drag due to the separation of the boundary layer on the side of the intrados can be suppressed to the minimum, and a further reduction in drag can be provided.

Figure 9:
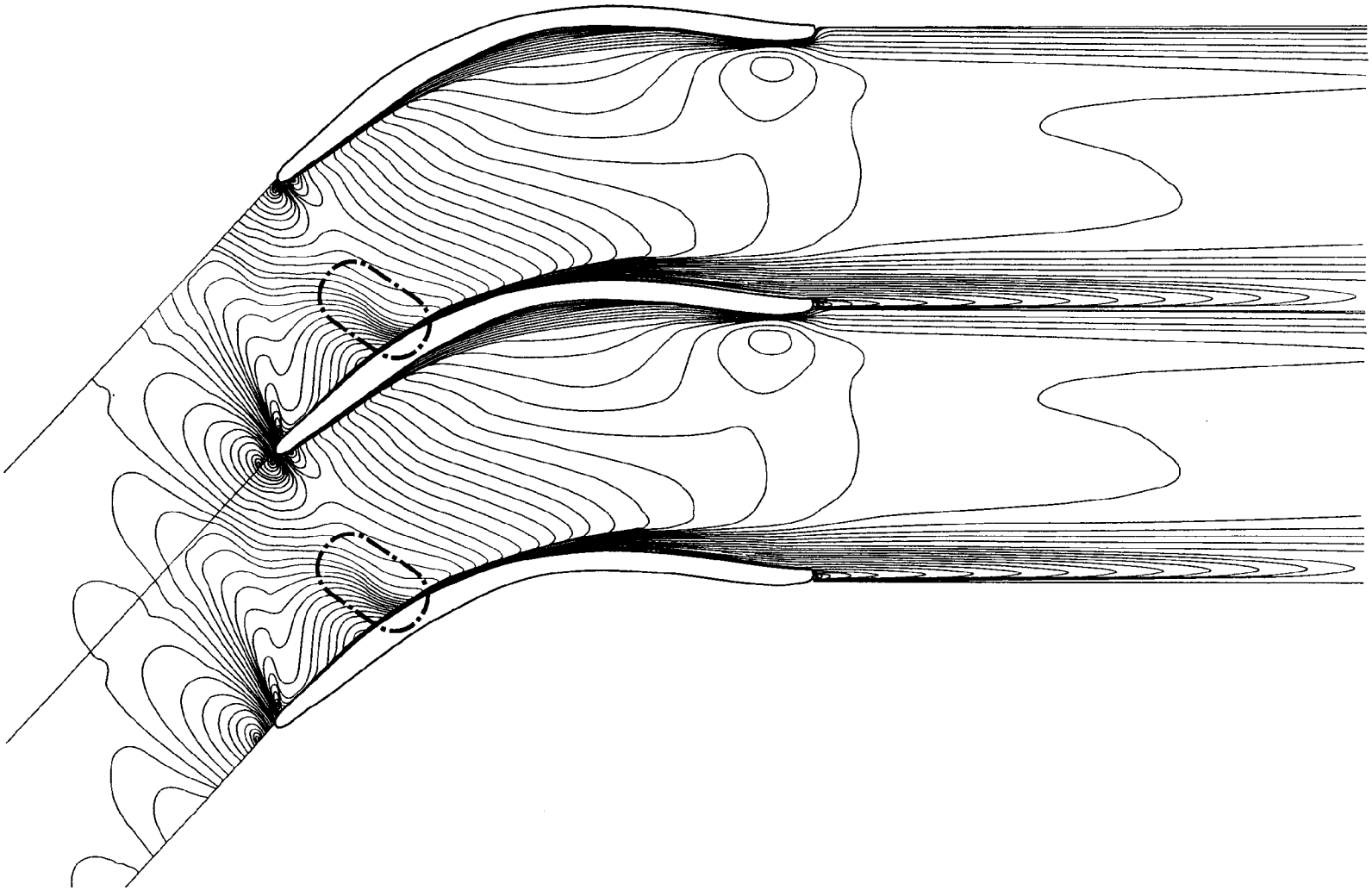
Figure 10:
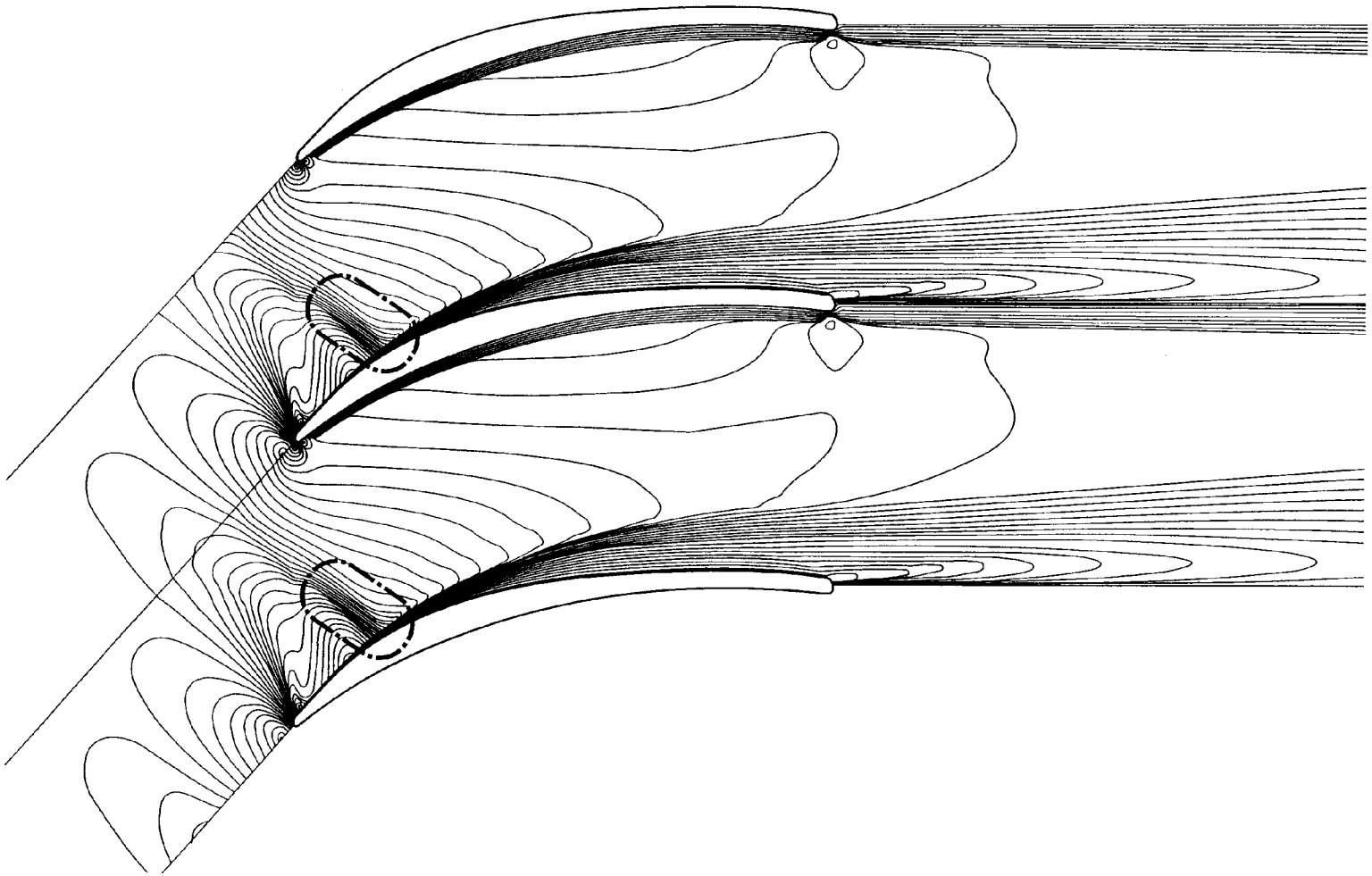

FIGS. 9 and 10 show, in a visualized manner, the behaviors of flows about the stator blades according to the first embodiment and the comparative example, respectively. In the first embodiment shown in FIG. 9, the pressure gradient at a rear portion of a shock wave in a section shown by drawing a dashed line is gentle as compared with that in the comparative example shown in FIG. 10, whereby an effect of reducing the wave drag is confirmed.

The effect in each of the first to third embodiments will be described below from the viewpoint of the stator blade cascade.

The distance between the intrados and the extrados in the stator blade cascade increases from the leading edge toward the trailing edge and reaches the maximum value; then decreases and reaches the minimum value, and then increases again, as described above. Therefore, by rendering the boundary layer on the intrados unstable in the section where the distance assumes the maximum value to positively separate the boundary layer, the generation of a shock wave on the extrados opposed to the boundary layer can be inhibited to reduce the wave drag. The frictional drag is increased due to the separation of the boundary layer on the intrados, but the increment in the frictional drag is by far smaller, as compared with the decrement in wave drag and hence, the overall drag is reduced largely.

Moreover, since the distance decreases to the minimum after reaching the maximum value, and then increases again, the flow on the intrados is accelerated again by throttling of the flow at a point corresponding to the minimum value, whereby the boundary layer is stabilized and thus, the promotion of the separation is inhibited. As a result, the increase in frictional drag due to the separation of the boundary layer on the intrados is inhibited, whereby the drag on the entire stator blade can be further reduced.

Although the embodiments of the present invention have been described in detail, it will be understood that the present invention is not limited to the above-described embodiments, and various modifications in design may be made without departing from the spirit and scope of the invention defined in claims.

For example, the position Xa of the front end of the second bulge is at 80% of the chord length C in the first embodiment, at 65% of the chord length C in the second embodiment and at 88% of the chord length C in the third embodiment, but may be established at any point in a range of 60% to 90%, and even in this case, a sufficient effect can be provided. The position Xb of the rear end of the first bulge is at 15% of the chord length C in the first embodiment, at 24% of the chord length C in the second embodiment and at 11% of the chord length C in the third embodiment, but may be established at any point in a range of 5% to 40%, and even in this case, a sufficient effect can be provided.

The solidity (the ratio of the chord length C to the distance between adjacent stator blades) is 2.0 in the first to third embodiments, but may be set in a range of 1.5 to 3.0, and even in this case, a sufficient effect can be provided.

What is claimed is:

1. A stator blade for an axial-flow compressor, having an intrados producing a positive pressure and an extrados producing a negative pressure, said stator blade being disposed in an annular fluid passage, both of said intrados and extrados being on one side of a chord line, characterized in that said stator blade includes a first bulge and a second bulge on said intrados at locations on the side of a leading edge and on the side of a trailing edge, respectively.

2. A stator blade for an axial-flow compressor according to claim 1, characterized in that the distance Xa from said leading edge to a front end of said second bulge is in a range of $0.60<Xa/C<0.90$ with respect to a chord length C.

3. A stator blade for an axial-flow compressor according to claim 2, characterized in that the distance Xb from said leading edge to a rear end of said first bulge is in a range of $0.05<Xb/C<0.40$ with respect to the chord length C.

4. A stator blade cascade for an axial-flow compressor, comprising a large number of stator blades disposed in an annular fluid passage, each said stator blade having an intrados producing a positive pressure and an extrados producing a negative pressure, characterized in that a distribution of distances between the intrados of one of two adjacent stator blades and the extrados of the other of two adjacent stator blades increases from a leading edge toward a trailing edge and reaches a maximum value; then decreases and reaches a minimum value; and then increases again.

5. A stator blade cascade for an axial-flow compressor according to claim 4, characterized in that said distance is a length a line drawn perpendicular to the extrados of said other stator blade.

6. A stator blade cascade for an axial-flow compressor according to claim 4, characterized in that a flow on the extrados of the stator blade is stabilized in a region where said distance assumes the maximum value.

7. A stator blade cascade for an axial-flow compressor according to claim 4, characterized in that a flow on the intrados of the stator blade is stabilized in a region where said distance assumes the minimum value.

8. A stator blade cascade for an axial-flow compressor according to claim 4, characterized in that the ratio of the chord length of the stator blade to the distance between adjacent stator blades is in a range of 1.5 to 3.0.

* * * * *